US006185383B1

(12) United States Patent
Kanari et al.

(10) Patent No.: US 6,185,383 B1
(45) Date of Patent: Feb. 6, 2001

(54) IMAGE HEATING APPARATUS

(75) Inventors: Kenji Kanari; Toshio Miyamoto; Masahiko Suzumi, all of Numazu (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/511,765

(22) Filed: Feb. 24, 2000

(30) Foreign Application Priority Data

Feb. 26, 1999 (JP) ..... 11-050707

(51) Int. Cl.[7] ..... G03G 15/00; H05B 1/00

(52) U.S. Cl. ..... 399/45; 399/69; 399/329; 399/334; 399/328; 219/216

(58) Field of Search ..... 219/216, 469, 219/470, 471; 399/45, 69, 320, 324, 328, 329, 334; 432/60

(56) References Cited

U.S. PATENT DOCUMENTS

| | | | | |
|---|---|---|---|---|
| 4,585,325 | * | 4/1986 | Euler | 399/328 |
| 4,801,968 | * | 1/1989 | Kogure et al. | 399/328 |
| 5,204,723 | * | 4/1993 | Hanada et al. | 399/328 |
| 5,253,024 | | 10/1993 | Okuda et al. . | |
| 5,293,202 | | 3/1994 | Adachi et al. . | |
| 5,860,051 | | 1/1999 | Goto et al. | 399/529 |
| 5,862,435 | | 1/1999 | Suzumi et al. | 399/68 |
| 5,920,757 | * | 7/1999 | Izawa et al. | 399/329 |

FOREIGN PATENT DOCUMENTS

| | | |
|---|---|---|
| 0 461 595 | 12/1991 | (EP) . |
| 63-313182 | 12/1988 | (JP) . |
| 2-157878 | 6/1990 | (JP) . |
| 4-044075 | 2/1992 | (JP) . |
| 4-044076 | 2/1992 | (JP) . |
| 4-044077 | 2/1992 | (JP) . |
| 4-044078 | 2/1992 | (JP) . |
| 4-044079 | 2/1992 | (JP) . |
| 4-044080 | 2/1992 | (JP) . |
| 4-044081 | 2/1992 | (JP) . |
| 4-044082 | 2/1992 | (JP) . |
| 4-044083 | 2/1992 | (JP) . |
| 4-204980 | 7/1992 | (JP) . |
| 4-204981 | 7/1992 | (JP) . |
| 4-204982 | 7/1992 | (JP) . |
| 4-204983 | 7/1992 | (JP) . |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

The present invention relates to an image heating apparatus in which an image on a moving recording material is heated by a heat from a heater, the heater has an elongated substrate extending in a direction perpendicular to a shifting direction of the recording material, and a first heat generating body and a second heat generating body for generating heat by energization and provided on the substrate along a longitudinal direction thereof, the first and second heat generating bodies are disposed side by side in a direction perpendicular to the longitudinal direction of the substrate, and the first heat generating body has a first heat generating portion, and a second heat generating portion provided at a longitudinal end of the first heat generating portion and having a heat generating amount per unit length smaller than that of the first heat generating portion, and, when the width of the recording material is detected to be smaller than a predetermined width by the detecting member, the first heat generating body is energized, and, when the width of the recording material is detected to be greater than the predetermined width, the second heat generating body is energized, and the detecting member is provided at a position corresponding to the second heat generating portion in the longitudinal direction of said substrate.

8 Claims, 7 Drawing Sheets

IMAGE HEATING APPARATUS

BACKGROUND OF THE INVENTION

1. Field of the Invention

The present invention relates to an image forming apparatus such as a copying machine, a printer and the like, and more particularly it relates to an image heating apparatus for heating an image on a recording material.

2. Related Background Art

In the past, in many image forming apparatuses of electrophotographic type such as electrophotographic copying machines, electrophotographic printers and the like, as fixing means, a fixing device of contact heating type having a heat roller and having good thermal efficiency and good safety or a fixing device of film heating type having reduced energy consumption has been used.

The fixing device of heat roller fixing type mainly comprises a fixing roller (heat roller) as a heating rotary member, and an elastic pressure roller as a pressure rotary member urged against the fixing roller and is designed so that, while a recording material (transfer sheet, electrostatic recording paper, electrofax paper, printing paper or the like) on which a non-fixed image (toner image) was formed and born is being passed through a fixing nip (abut nip portion) between the rotating rollers, the non-fixed image is permanently fixed to the recording material by heat from the fixing roller and pressure in the fixing nip.

Further, the fixing device of film heating type is disclosed in Japanese Patent Application Laid-open Nos. 63-313182, 2-157878, 4-44075, 4-44076, 4-44077, 4-44078, 4-44079, 4-44080, 4-44081, 4-44082, 4-44083, 4-204980, 4-204981, 4-204982, 4-204983 and 4-204984, for example, and comprises a heating body (heater) and a heat-resistive fixing film (heating rotary member) slidingly contacted with the heating body by a pressurizing rotary member (elastic roller) and is designed so that, while a recording material on which a non-fixed image was born is being passed together with the fixing film through a fixing nip portion between the heating body and the pressurizing rotary member with the interposition of the fixing film, the non-fixed image is permanently fixed to the recording material by heat from the heating body via the fixing film and pressure in the fixing nip portion.

In the fixing device of film heating type, since a wire-shaped heating body having low heat capacity can be used as the heating body and a thin film having low heat capacity can be used as the fixing film, electric power can be saves, and weight and time reduction (on-demand, quick start) can be achieved.

As the wire-shaped heating body having low heat capacity, a so-called ceramic heater can generally be used. The ceramic heater mainly comprises a ceramic substrate made of alumina, aluminum nitride or the like, and a heating body provided on the substrate and capable of generating heat by energization.

Thus, the fixing device of film heating type has various advantages such as unnecessity of waiting pre-heating and elimination of a waiting time due to high heating efficiency and fast rising-up. Particularly, since a method in which a cylindrical film is driven by a conveying force of a pressurizing roller can be realized with low cost, such a method has been adopted to low speed compact image forming apparatuses and is expected to be introduced into large-sized high speed image forming apparatuses in the future.

In the fixing device of film heating type, it is required that a length of a heating element of the heating body be equal to or greater than a maximum of a sheet size, and temperature control of the heating body is effected by detecting a temperature of the heating body by means of a thermistor (temperature detecting element) disposed in the vicinity of a longitudinal center of the heating body. Thus, when a sheet having maximum size is passed, the heat generated from the heating body is absorbed by the sheet, with the result that the temperature of the entire heating body is decreased.

On the other hand, when a sheet having a size smaller than the maximum size is passed in a center standard, since the temperature of only a central portion of the heating body on which the sheet is passed is decreased, the temperature of non-sheet passing portions of the heating body is increased in comparison with the central portion (non-sheet passing portion temperature increase phenomenon), with the result that portions of the film and the pressurizing roller corresponding to both lateral edge portions of the heating body may be damaged. Further, after the small sized sheet was passed, if a larger sized sheet is passed, offset (adhesion of toner to the film) will occur by the influence of the temperature-increased edge portions.

Conventionally, in order to solve this problem, a method in which through-put is reduced (i.e., print frequency is reduced) to widen sheet passing interval has been utilized.

However, the non-sheet passing portion temperature increase phenomenon has become more severe due to high speed tendency of the on-demand fixing device of film heating type, and, thus, it is very difficult to solve the above problem only by reduction of through-put.

In order to solve such a problem, it is considered that heating elements having different lengths and widths are provided on a substrate of the heating body so that the heating elements are selectively energized in accordance with a sheet size of a recording material to be passed (zone heating).

FIGS. 10A and 10B shows an example of the zone heating which is background of the present invention. In FIG. 10A, there are provided a ceramic heater 100 as a heating body, a heater holder 2, a heat-resistive fixing film 3 and an elastic pressurizing roller 4.

The heater 100 is held by the heater holder 2 with a heating surface facing downwardly, and the elastic pressurizing roller 4 is urged against the downwardly facing heating surface of the heater 100 with the interposition of the fixing film 3, thereby forming a fixing nip portion N.

The heater 100 is heated and temperature-adjusted to a predetermined temperature by energization of heating elements. The fixing film 3 is slid on the downwardly facing heating surface of the heater 100 in the fixing nip portion N and is shifted in a direction shown by the arrow.

In a condition that the heater 100 is heated and temperature-adjusted to the predetermined temperature and the fixing film 3 is shifted in the direction shown by the arrow, when a recording material P on which a non-fixed toner image t was formed and born is introduced between the fixing film 3 and the elastic pressurizing roller 4 at the fixing nip portion N, the recording material P is conveyed together with the fixing film 3 through the fixing nip portion N while being closely contacted with the surface of the fixing film 3. In the fixing nip portion N, the recording material P and the toner image t are heated by the heater 100 via the fixing film 3, with the result that the toner image t on the recording material P is thermally fixed to the recording material P. A portion of the recording material passed through the fixing nip portion N is separated from the surface of the fixing film and is conveyed.

FIG. 10B is a partially sectioned schematic plan view of the ceramic heater 100 as the heating body (showing a back side of the heater). The heater 100 comprises a heater substrate 100*a* having a longitudinal direction perpendicular to a sheet passing direction, two parallel heat generating member for large sized sheet (large sized sheet heating element) h1 and heat generating member for small sized sheet (small sized sheet heating element) h2 formed on the back surface of the heater substrate 100*a* along the longitudinal direction thereof, electricity supplying electrode pattern portions a, b, c for the heating elements h1, h2, and a glass coating layer 100*b* over-coated on the heating element forming surface of the heater substrate.

The heater substrate 100*a* is a ceramic substrate having insulation capacity, good heat transferring ability and low heat capacity and is made of aluminum nitride in this example.

The heating elements h1, h2 are heat generating resistance bodies for generating heat by energization and are formed by pattern-printing and firing heat generating resistance paste made of silver palladium (Ag/Pd), $Ta_2N$ or the like.

The electricity supplying electrode pattern portions a, b, c are formed by pattern-printing and firing silver (Ag) paste.

The glass coating layer 100*b* is formed by pattern-printing and firing glass paste. The glass coating layer 100*b* is provided for protecting the heating elements h1, h2 and for ensuring insulation against an electric element such as a thermistor and the surface of the film.

In this example, in the heater 100, a surface of the heater opposite to the surface on which the heating elements h1, h2 are formed is used as a heating surface on which the fixing film 3 is closely contacted and slidingly shifted (back surface heating heater).

The large sized sheet heating element h1 corresponds to the maximum sheet passing width for LTR size (width=215.9 mm), A4 size (width=210 mm), EXE size (width=184.2 mm) and C5 size (width=162 mm) and has a length L1 of 222 mm.

The small sized sheet heating element h2 is provided for envelopes of DL size (width=114 mm), com10 (=104.7 mm) and monarch (=98.4 mm) and has a length L2 of 116 mm.

In this example, the sheet is passed with center standard (reference).

Among the electricity supplying electrode pattern portions a, b, c, the electricity supplying electrode pattern portion c serves as a common electrode for the heating elements h1 and h2.

When the large sized sheet is passed, the large sized sheet heating element h1 is used for heating, and, when the small sized sheet is passed, the small sized sheet heating element h2 is sued for heating. In this way, the zone heating is effected. That is to say, when the large sized sheet is passed, electricity is supplied between the electricity supplying electrode pattern portions a and c to cause the large sized sheet heating element h1 to generate heat, thereby coping with the passing of the large sized sheet. When the small sized sheet is passed, electricity is supplied between the electricity supplying electrode pattern portions b and c to cause the small sized sheet heating element h2 to generate heat, thereby coping with the passing of the small sized sheet. In this way, the non-sheet passing portion temperature increase can be prevented.

Although not shown, a thermistor (temperature detecting element) is provided to be contacted with the surface of the glass coating layer 100*b* on the back surface of the heater in the vicinity of the longitudinal center of the heater. The temperature of the heater is detected by the thermistor and a temperature adjusting circuit so that the temperature of the heater can be controlled.

Although it is impossible to correspond lengths of heating elements to all of sheet sizes, as shown in FIGS. 10A and 10B, even when two kinds of heating elements h1, h2 having different lengths to cope with the main sheet sizes are provided, increase in temperature of the non-sheet passing portions can be suppressed, thereby greatly improving a print speed for the small sized sheet.

However, the above-mentioned zone heating has the following disadvantage.

That is to say, as mentioned above, the large sized sheet heating element h1 having larger length and the small sized sheet heating element h2 having smaller length are arranged side by side on the heater substrate 100*a* and a sheet width sensor is disposed inside of the small sized sheet heating element h2 with respect to the longitudinal direction.

The sheet width sensor recognizes the passed recording material as a large sized sheet when it detects the passed recording material and recognizes the passed recording material as a small sized sheet when it does not detect the passed recording material.

The reason why the sheet width sensor is disposed inside of the small sized sheet heating element h2 is that, regarding the temperature distribution of the pressurizing roller, since there is temperature sagging (reduction) at portions of the roller corresponding to ends of the heating elements, if the sheet width sensor is arranged outside of the small sized sheet heating element, poor fixing may occur at both lateral edges of the small sized sheet, and, thus, the sheet width sensor must be disposed inside of the small sized sheet heating element.

By the way, although the length of the small sized sheet heating element h2 is set to be greater than the maximum width of the small sized sheet in consideration of the end temperature reduction, since the heating element h2 is essentially provided for coping with the non-sheet passing portion temperature increase, it is preferable that the length of the heating element is made small as less as possible. So long as the sheet width sensor is disposed outside of the maximum width of the small sized sheet and inside of the minimum width of the large sized sheet, there is no problem. However, since the sheet width sensor is disposed inside of the small sized sheet heating element h2 the length of which is made small as less as possible, a distance between the end of the maximum width of the small sized sheet and the position of the sheet width sensor becomes very small. Thus, even when the sheet width sensor is disposed inside of the small sized sheet heating element h2, if the recording material is deviated laterally away from the sheet width sensor, the lateral edge of the recording material is substantially aligned with the end of the heating element h2, with the result that poor fixing may occur.

Further, if the small sized recording material is skew-fed, it is passed outside of the sheet width sensor, with the result that the sheet width sensor recognizes the recording material as a small sized sheet, thereby energizing the large sized sheet heating element h1. In this case, portions of the pressurizing roller and the film corresponding to the non-sheet passing portions may be damaged or offset due to end temperature increase may occur.

SUMMARY OF THE INVENTION

An object of the present invention is to provide an image heating apparatus in which, even if a small sized recording material is deviated laterally, poor fixing at a lateral edge of the recording material can be prevented while preventing the non-sheet passing portion temperature increase.

Another object of the present invention is to provide an image heating apparatus in which, even if a small sized recording material is skew-fed, the small sized sheet can be prevented from being erroneously detected as a large sized recording sheet.

A further object of the present invention is to provide an image heating apparatus comprising a heater and a detecting member for detecting a width of the recording material, an image on a moving recording material being heated by a heat from the heater, the heater including an elongated substrate extending in a direction perpendicular to a shifting direction of the recording material, and first and second heat generating bodies for generating heat by energization and provided on the substrate along a longitudinal direction thereof, the first and second heat generating bodies being disposed side by side in a direction perpendicular to the longitudinal direction of the substrate, and the first heat generating body having a first heat generating portion, and second heat generating portions provided at longitudinal ends of the first heat generating portion and having a heat generating amount per unit length smaller than that of the first heat generating portion, when the width of the recording material is detected to be smaller than a predetermined width by the detecting member, the first heat generating body is energized, and, when the width of the recording material is detected to be greater than the predetermined width, the second heat generating body is energized, and the detecting member is provided at a position corresponding to the second heat generating portion in the longitudinal direction of the substrate.

A still further object of the present invention is to provide an image heating apparatus comprising a heater and a detecting member for detecting a width of the recording material, an image on a moving recording material being heated by a heat from the heater, the heater including an elongated substrate extending in a direction perpendicular to a shifting direction of the recording material, and first and second heat generating bodies for generating heat by energization and provided on the substrate along a longitudinal direction thereof, the first and second heat generating bodies being disposed side by side in a direction perpendicular to the longitudinal direction of the substrate, and a length of said first heat generating body being smaller than a length of the second heat generating body with respect to the longitudinal direction of the substrate, when the width of the recording material is detected to be smaller than a predetermined width by the detecting member, the first and second heat generating bodies are energized, and, when the width of the recording material is detected to be greater than the predetermined width, the second heat generating body is energized, and the detecting member is provided at a position outside of the first heat generating body and inside of the second heat generating body in the longitudinal direction of the substrate.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

Figure 1:
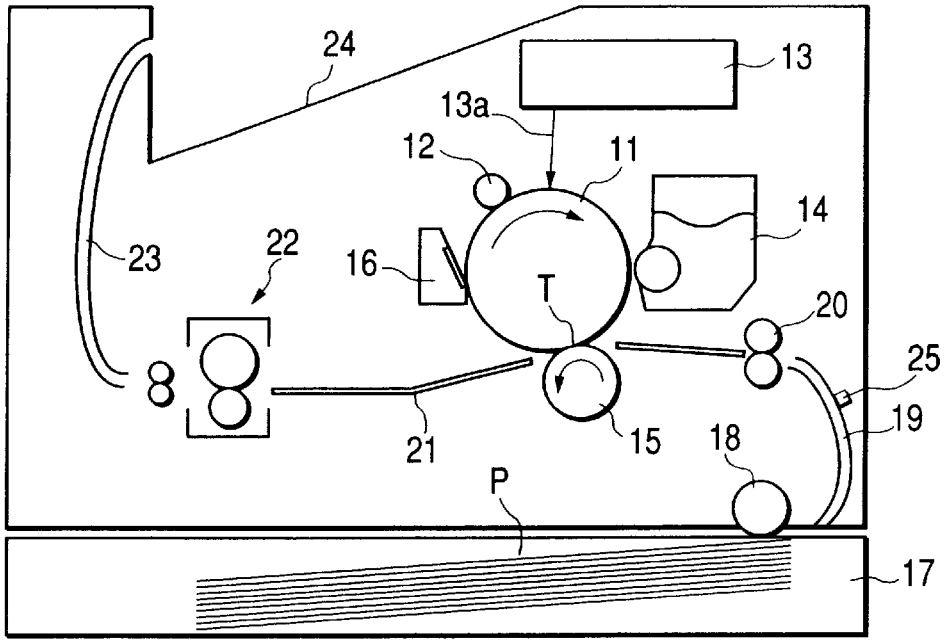
FIG. 1 is a schematic constructural view of an image forming apparatus to which the present invention is applied.

FIG. 1 is a schematic constructural view of an image forming apparatus to which the present invention is applied. The image forming apparatus according to the this example is a laser beam printer using a transfer electrophotographic process.

A rotating drum-type electrophotographic photosensitive member (referred to as "photosensitive drum" hereinafter) 11 as an image bearing member is constituted by forming photosensitive material such as OPC, amorphous silicone or the like on a cylindrical substrate made of aluminum, nickel or the like and is rotated at a predetermined peripheral speed in a clockwise direction shown by the arrow.

The photosensitive drum 11 is uniformly charged, during the rotation, with predetermined polarity and potential by means of a charging roller (charging device) 12.

Then, the photosensitive drum is subjected to laser beam scanning exposure 13*a* by means of a laser scanner (exposing device) 13. The laser scanner 13 outputs a laser beam ON/OFF-controlled in response to a time-lapse electrical digital pixel signal corresponding to target image information, thereby scan exposing the uniformly charged surface of the rotating photosensitive drum 11. As a result, an electrostatic latent image corresponding to the scan exposed pattern is formed on the photosensitive drum 11.

The electrostatic latent image formed on the photosensitive drum 11 is developed by a developing device 14 as a toner image. A developing method may be a jumping developing method or a two-component developing method and, in most cases, utilizes a combination of image exposing and reversal developing.

At a transfer nip portion T defined between the photosensitive drum 11 and a transfer roller (transfer device) 15, the toner image formed on the photosensitive drum 11 are successively transferred onto a recording material (transfer material) supplied to the transfer nip portion T from a sheet feeding portion 17 at a predetermined control timing. Predetermined transfer bias is applied to the transfer roller 15 from a power supply (not shown), so that the toner image on the photosensitive drum 11 is transferred onto the recording material P at the transfer nip portion T under the action of the transfer bias.

The sheet feeding portion 17 is a cassette sheet feeding portion in which the recording materials P stacked and contained therein are separated one by one by cooperation of a sheet feeding roller 18 and a separating member (not shown). And, the separated recording material is supplied to the transfer nip portion T at the predetermined control timing through a sheet path including a pair of registration rollers 20. That is to say, the recording material P is supplied to the transfer nip portion T in synchronous with the toner image formed on the photosensitive drum 11 by means of the pair of registration rollers 20.

The recording material P to which the toner image was transferred at the transfer nip portion T is separated from the surface of the photosensitive drum 11 and is conveyed, through a guide 21, to a fixing device (image heating apparatus) 22, where the toner image is heated to be fixed to the recording material P as a permanent fixed image. The fixing device 22 will be described later.

The recording material P to which the image was fixed and outputted from the fixing device 22 is discharged onto a sheet discharge portion 24 out of the apparatus through a sheet path 23.

On the other hand, after the toner image was transferred to the recording material P, residual toner remaining on the photosensitive drum 11 is removed from the surface of the photosensitive drum 11 by a cleaning device 16, and the cleaned photosensitive drum 11 is used for next image formation.

There is provided a sheet size detecting sensor 25 for detecting a width of the recording material perpendicular to a shifting direction of the recording material.

Figure 2:
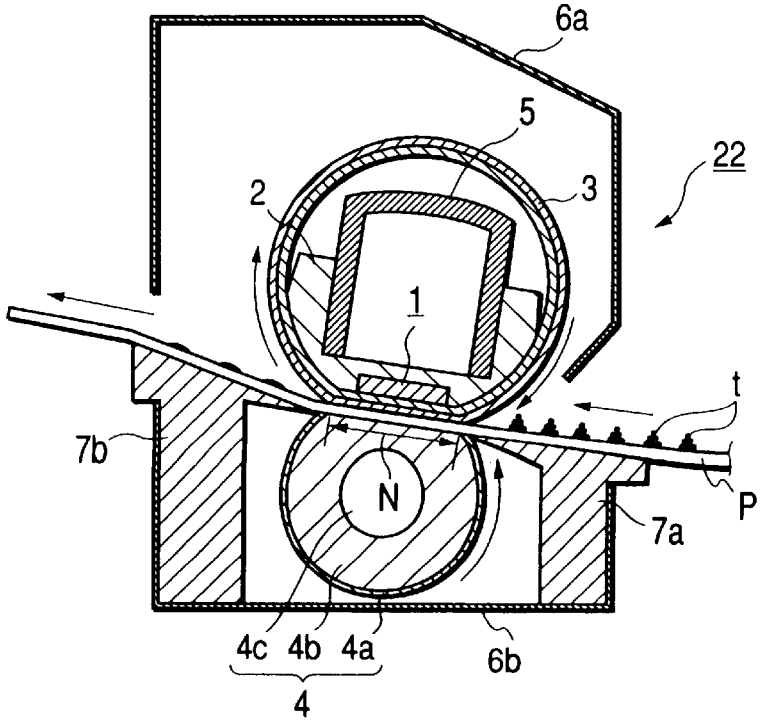
FIG. 2 is a schematic enlarged view of a fixing device.

FIG. 2 is an enlarged cross-sectional view of the fixing device 22. The fixing device 22 according to the illustrated embodiment is an on-demand apparatus of film heating, pressurizing roller-driven and tensionless type using a cylindrical (endless) fixing film (heat-resistive film) as disclosed in Japanese Patent Application Laid-open Nos. 4-44075 to 4-44083.

The fixing device comprises a heater 1, a heater holder 2 also acting as a film guide member, a cylindrical fixing film 3, an elastic pressurizing roller 4, a metallic stay 5, upper and lower device frames 6*a,* 6*b,* a fixing inlet guide 7*a* and a discharge guide 7*b*.

The heater 1 is a so-called ceramic heater. The heater will be fully described later.

The heater holder 2 is a member having a longitudinal direction perpendicular to the plane of FIG. 2 and having an arc trough cross-section and having heat-resistive and electrically insulative and capable of bearing great load and is formed from heat-resistive material such as liquid crystal polymer, phenol resin, PPS or PEEK. The heater 1 is fitted into and secured to a longitudinal recess formed in a lower surface of the heater holder at substantially center thereof, with a heating surface of the heater revealing or facing downwardly.

The cylindrical fixing film 3 is loosely fitted outwardly around the heater holder 2 including the heater 1 with an allowance, and the heater holder 2 supports the fixing film 3 from the inside.

Figure 3:
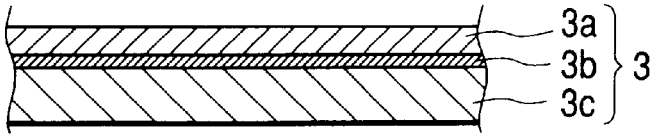
FIG. 3 is a schematic view showing a layer structure of a fixing film.

In order to reduce heat capacity thereby to enhance quick start ability, the fixing film 3 is formed from a single layer film having a total thickness of 100 $\mu$m or less (preferably, 40 $\mu$m or less and 20 $\mu$m or more) and made of material such as PTFE, PFA or PPS having heat-resistance, good mold releasing ability, adequate strength and endurance, or, as shown in FIG. 3, a multi-layer film constituted by coating or tube-forming a surface mold releasing layer 3*a* (made of fluororesin such a PTFE, PFA or FEP) on a base layer film 3*c* (made of material such as polyimide, polyamideimide, PEEK or PES) via conductive primer layer 3*b*.

The elastic pressurizing roller 4 is a rotary member comprising a metal core 4*c,* a heat-resistive rubber (such as silicone rubber) layer 4*b* formed around the metal core, and an outermost mold releasing layer 4*a* and is rotatably supported by a lower frame 7*b* of the apparatus via bearings supporting both ends of the metal core 4*c*.

The heater holder 2 holding the heater 1 and on which the fixing film 3 is fitted outwardly is arranged on an upper frame 6*a* of the apparatus in such a manner that the downwardly facing heater 1 is opposed to the upper surface of the elastic pressurizing roller 4. By pushing a metallic stay 5 of the heater holder 2 downwardly by means of pressing means (not shown), the heater holder 2 is urged downwardly, with the result that the heater is urged against the upper surface of the elastic pressurizing roller 4 with the interposition of the fixing film 3. The total pressing force is about 4 kgf ($4\times9.806\cong39.2$N) to 15 kgf ($15\times9.806\cong147.1$N) so that a fixing nip portion N required for heating and fixing is formed between the heater 1 and the elastic pressurizing roller 4 with the interposition of the fixing film 3.

The elastic pressurizing roller 4 is rotatingly driven in an anti-clockwise direction shown by the arrow by driving means (not shown) (pressurizing rotary member driving system). When the elastic pressurizing roller 4 is rotated, by a contact frictional force between the outer surface of the roller 4 and the outer surface of the fixing film 3 at the fixing nip portion N, the fixing film 3 is subjected to a rotational force, with the result that the fixing film is rotatingly driven (around the heater holder 2) in a clockwise direction shown by the arrow at a peripheral speed substantially the same as the peripheral rotational speed of the elastic pressurizing roller 4 while slidingly contacting with the downwardly facing heating surface of the heater 1 at the fixing nip portion N.

In this case, the circumferential length of the cylindrical fixing film 3 rotatingly driven around the heater holder 2 is in a tension-free condition (condition that tension does not acts on the film length), except for a portion of the fixing film 3 in the fixing nip portion N and therearound.

Since the fixing film 3 is rotated while the inner surface thereof being slidingly contacted with the heater 1 and a portion of the outer surface of the heater holder 2, it is required that the frictional resistance between the heater 1/heater holder 2 and the fixing film 3 be minimized. To this end, a small amount of lubricant such as heat-resistive grease is coated on the heater 1 and the surface of the heater holder 2. In this way, the fixing film 3 can be rotated smoothly.

Figure 4:
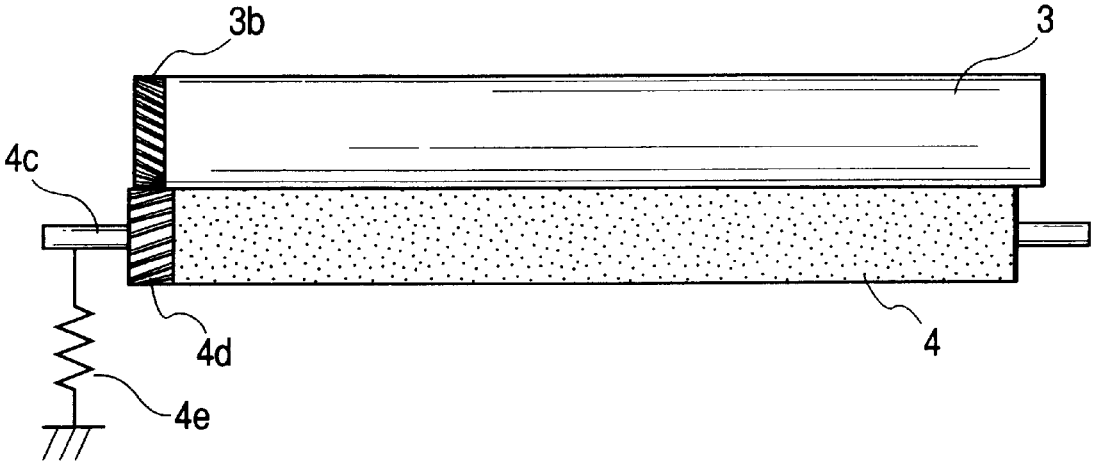
FIG. 4 is a view for explaining the grounding of the fixing film via resistor.

Further, in the case where the fixing film 3 is formed from the multi-layer film including the conductive primer layer 3*b* as shown in FIG. 3, as shown in FIG. 4, the conductive primer layer 3*b* is exposed at the lateral edge of the fixing film 3, and a conductive rubber ring 4*d* is fitted onto the metal core 4*c* of the pressurizing roller in a confronting relationship to the exposed primer layer 3*b* and is grounded via a resistor 4*e*. And, by contacting the conductive rubber ring 4*d* with the exposed conductive primer layer 3*b,* the primer layer 3*b* of the fixing film 3 can be grounded, with the result that potential of the fixing film 3 is stabilized, thereby eliminating a bad electrostatic influence upon the charged toner image on the recording material.

When the elastic pressurizing roller 4 is rotated, the cylindrical fixing film 3 is rotatingly driven around the heater holder 2. When electricity is supplied to the heater 1, the temperature of the fixing nip portion N is risen up to a predetermined value and temperature-adjusted by the heat from the heater. In this condition, the recording material P on which the non-fixed toner image t was formed and born is introduced into the fixing nip portion N along the fixing inlet guide 7*a,* and, at the fixing nip portion N, the surface of the recording material P bearing the non-fixed toner image is closely contacted with the outer surface of the fixing film 3 so that the recording material is passed through the fixing nip portion N together with the fixing film 3.

While the recording material P is being pinched and conveyed, the heat from the heater 1 is applied to the recording material P via the fixing film 3, with the result that the non-fixed toner image t is fixed to the recording material P by heat and pressure.

When the recording material P passes the fixing nip portion N, the recording material is separated from the outer surface of the fixing film 3 by a curvature separation and then is conveyed and discharged along the discharge guide 7*b*.

In the illustrated embodiment, in the fixing device of zone heating in which the heat generating elements to be heated are selected in accordance with the width of the recording material, when a small sized recording material is subjected to the fixing, heat generating elements having different heat generating amounts in the longitudinal direction thereof are used, and a sheet size detecting sensor 25 is provided outside of the portion having greater heat generating amount.

Figure 5:
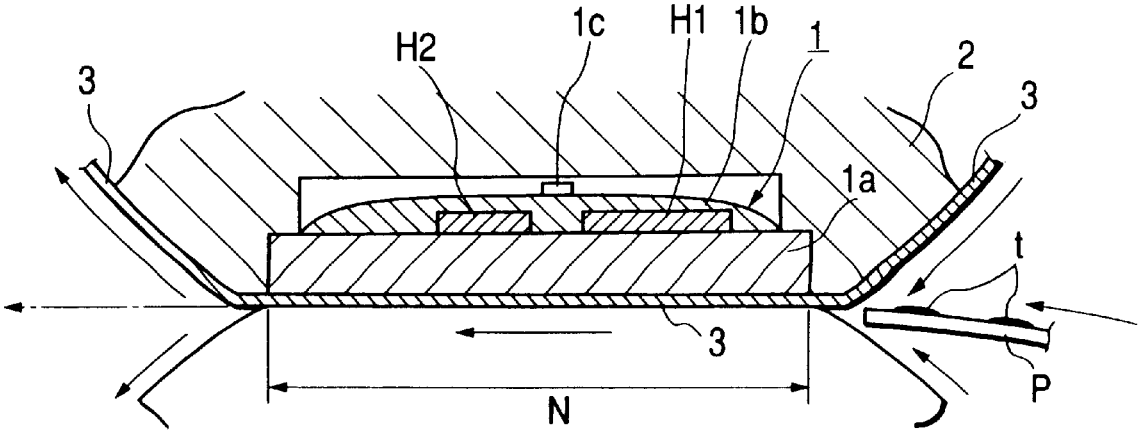
FIG. 5 is a schematic enlarged view of a fixing nip portion.
Figure 6:
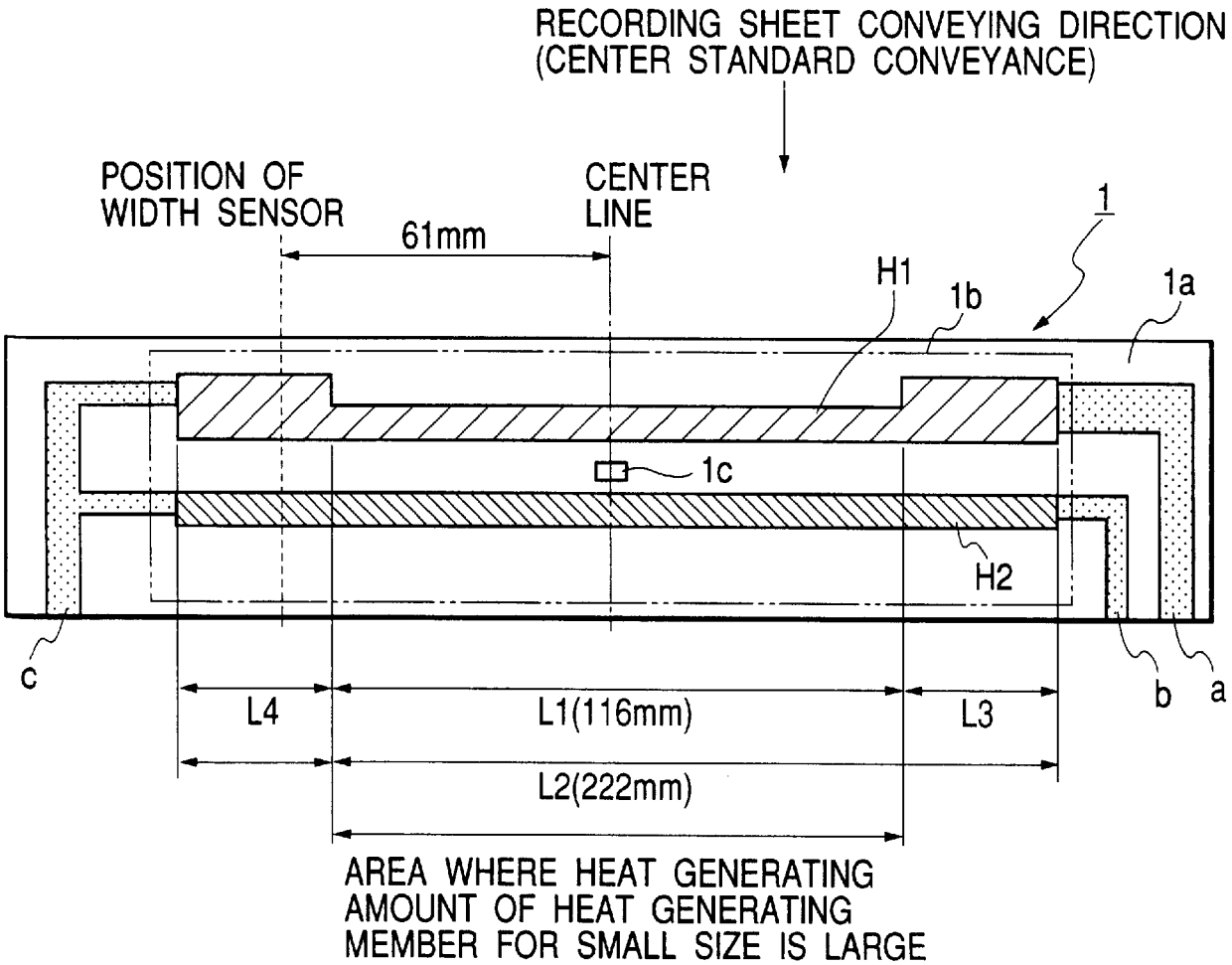
FIG. 6 is a schematic view showing heating elements and electricity supplying electrode patterns of a heating body.

FIG. 5 is an enlarged cross-sectional view of the fixing nip portion N. FIG. 6 is a view showing a pattern of the heat generating elements of the ceramic heater 1 as the heating body.

Figure 10A:
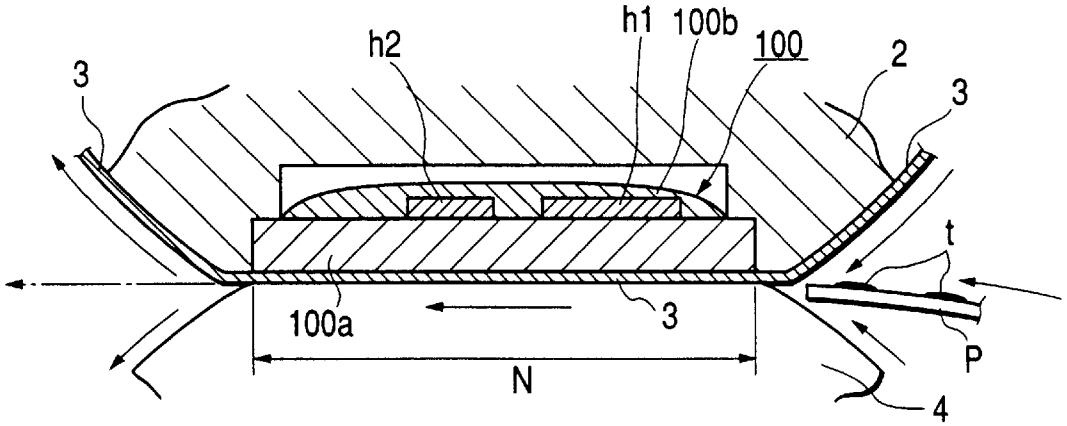
FIGS. 10A and 10B are explanatory views of a fixing device of film heating type which is background of the present invention.
Figure 10B:
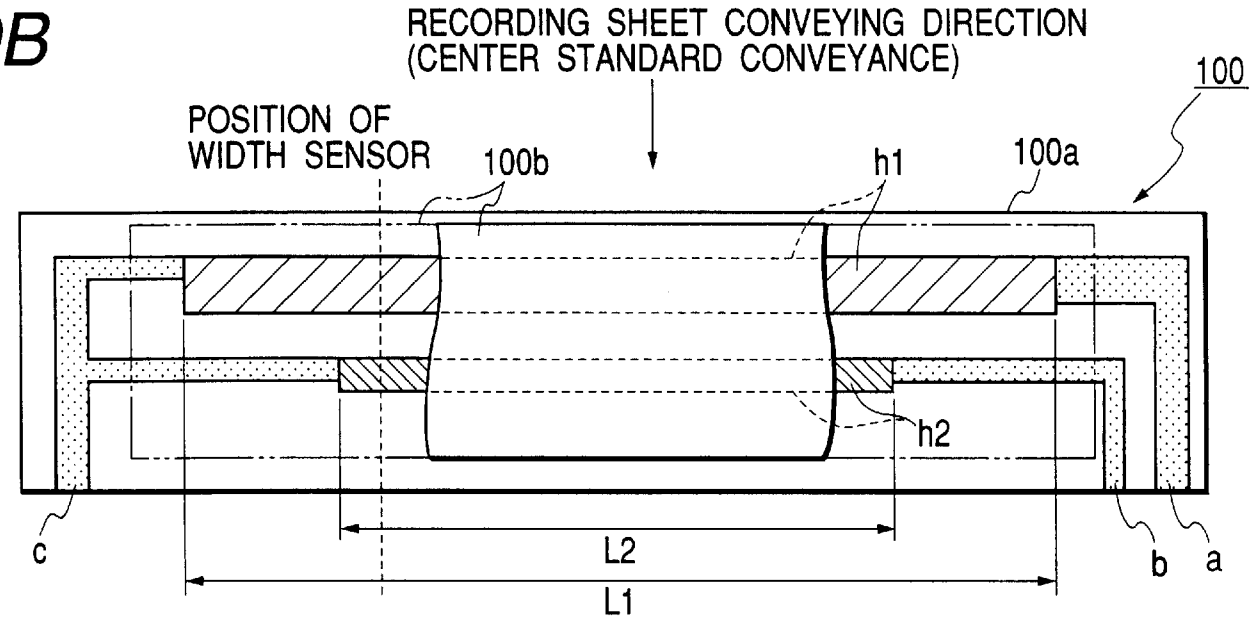

Similar to the heater in the apparatus of FIGS. 10A and 10B (referred to as "comparative example" hereinafter), the heater 1 according to the illustrated embodiment is a heating apparatus of rear surface heating, zone heating and center reference conveying type in which aluminum nitride is used as the heater substrate 1*a*. Incidentally, the reference numeral 1*b* denotes a glass coating layer; and 1*c* denotes a temperature detecting element for detecting the temperature of the heater.

In the heater 1 according to the illustrated embodiment has a small sized sheet heat generating element (first heat generating element) H1 and a large sized sheet heat generating element (second heat generating element) H2, which elements have length L2 of 222 mm in the longitudinal direction. The length L2 (=222 mm) corresponds to the maximum sheet passing width for LTR, A4, EXE and C5 sizes series. The large sized sheet heat generating element H2 is uniformly heated along its entire area by applying electricity between electricity supplying electrode pattern portions b and c.

In the small sized sheet heat generating element H1, a central portion thereof (first heat generating portion) having a length L1 (small sized sheet passing area) of 116 mm is narrower than both end portions (second heat generating portions) having lengths L3, L4 (non-sheet passing areas) of 53 mm. The length L1 (=116 mm) of the small sized sheet passing area of the small sized sheet heat generating element H1 corresponds to the envelopes series such as DL, com10 and monarch.

The small sized sheet heat generating element H1 is heated by applying electricity between the electricity supplying electrode pattern portions a and c. However, since the paste area of the small sized sheet passing area L1 is small, the greater heat is generated at the area L1. Although the non-sheet passing areas L3, L4 also generate the heat, since they have greater areas, the heat generating amount is smaller.

By detecting the size of the recording material being passed by means of the width sensor 25 provided in the recording material conveying path, the heat generating element H1 or H2 to be heated is selected. That is to say, when the large sized sheet is passed, the large sized sheet heat generating element H2 which is uniformly heated is selected to be heated; whereas, when the small sized recording material having the width smaller than L1 is passed, the small sizes sheet heat generating element H1 is heated.

In the case where the zone heating is not effected and only a single heat generating element having uniform longitudinal temperature distribution is used, if small sized sheets are continuously passed, the non-sheet passing areas are over-heated. Immediately after, if a large sized sheet is passed, regarding both lateral edges of the large sized sheet, since the temperature of the corresponding portions of the fixing nip portion is too high, toner offset will occur. Further, the pressurizing roller and the films will be damaged, thereby shortening the service life of the apparatus. To the contrary, according to the illustrated embodiment, since the small sized sheet heat generating element H1 is also used, the non-sheet passing areas L3, L4 are not over-heated, with the result that the above-mentioned inconveniences can be avoided.

When it is assumed that the heat generating amount of the small sized sheet passing portion L1 of the small sized sheet heat generating element H1 per unit longitudinal length is QL1, the heat generating amounts QL3, QL4 of the non-sheet passing areas L3, L4 per unit area become as follows:

$$QL3=QL4=\tfrac{1}{2}\cdot QL1$$

The heat generating amounts (½·QL1) of the areas L3, L4 are so small as not to generate hot offset and damage of the apparatus.

The width sensor 25 is disposed at a position spaced apart from the centerline corresponding to the center of the longitudinal heat generating element by a predetermined distance of 61 mm (½ of the length) and serves to recognize the sheets such as monarch, com10 and DL as a small sized sheet to command the heating of the small sized sheet heat generating element H1.

The sensor recognizes sheets such as C5, EXE, A4 and LTR as a large sized sheet to command the heating of the large sized sheet heat generating element H2.

Further, the width sensor 25 has a flag which is positioned in the sheet conveying path and which is not fallen when the recording material having a width smaller than the predetermined width is passed and is fallen when the recording material having a width greater than the predetermined width is passed. On the basis of a detection result of the width sensor 25, the heat generating element to be heated is selected, and, energization of the heat generating element H1 or H2 is controlled to maintain a desired temperature, on the basis of the detected temperature from the thermistor 1*c*.

As shown in FIG. 6, with respect to the longitudinal direction of the heater, the width sensor 25 is disposed outside of the small sized sheet passing area L1 (having greater heat generating amount when the small sized sheet heat generating element H1 is heated) and at a position corresponding to the non-sheet passing area L4. Namely, since the non-sheet passing area L4 is heated, the sheet width sensor can be arranged outside of the sheet passing area L1, and this position of the sheet width sensor is a position relatively spaced apart from the end of the maximum width of the small sized recording material.

Figure 7:
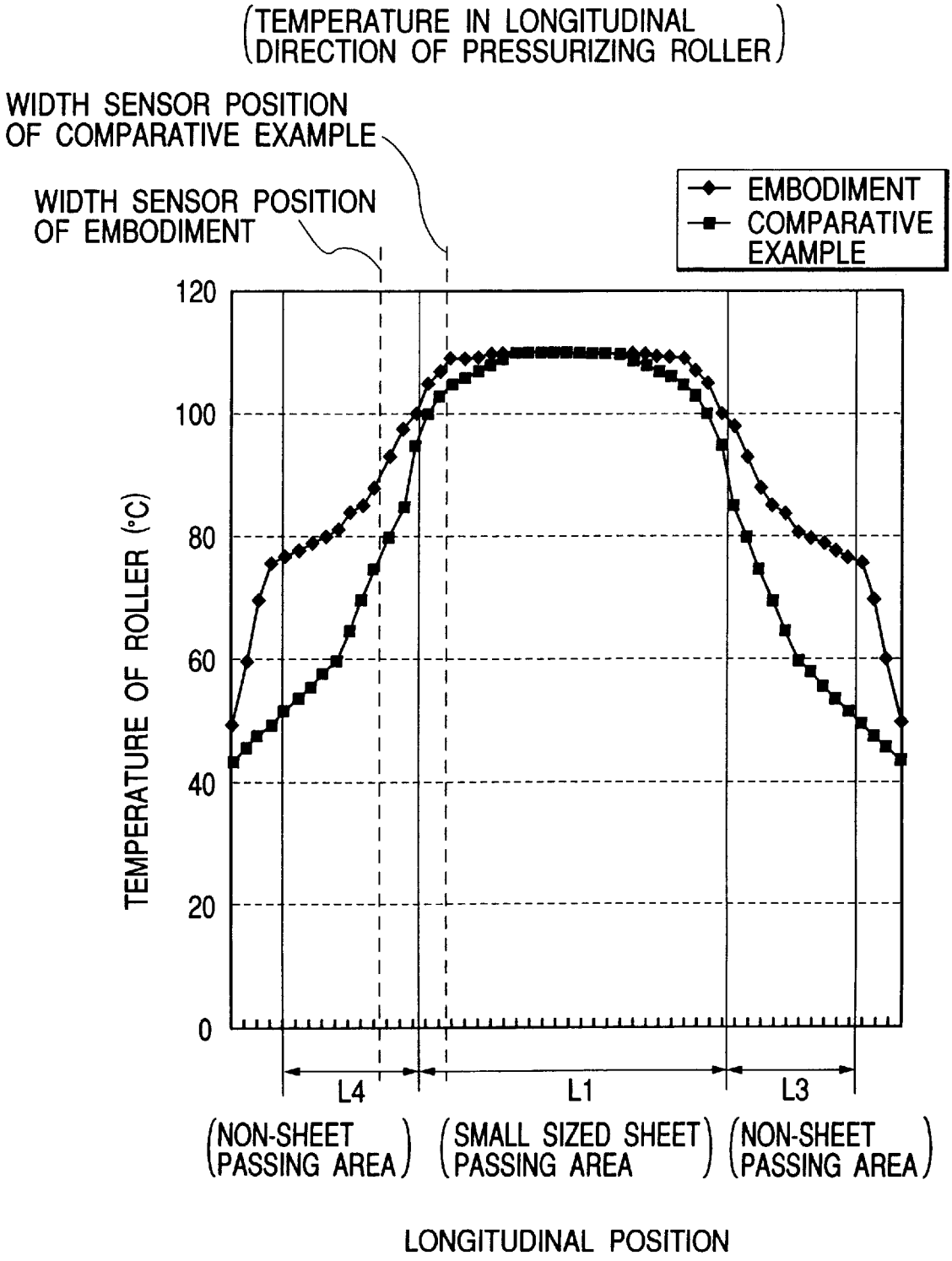
FIG. 7 is a view showing temperature distribution of a pressurizing roller in a longitudinal direction thereof.

FIG. 7 is a graph showing temperature distribution in a longitudinal direction of the pressurizing roller before the sheet enters into the fixing nip portion N when the small sized sheet is fixed by using the small sized sheet heat generating element or body, in each of the illustrated embodiment and the comparative example.

As can be seen from FIG. 7, in the comparative example, at the non-sheet passing areas, the roller temperature is abruptly decreased; whereas, in the illustrated embodiment, the temperature is gradually decreased with a gentle slope. Further, the decrease in temperature outside of the width sensor is gentle in the illustrated embodiment in comparison with the comparative example.

In the comparative example, the temperature of the portions of the pressurizing roller at the non-sheet passing areas, i.e., outside of the small sized sheet heat generating element is small. To the contrary, according to the illustrated embodiment, since the pressurizing roller is moderately warm also at the non-sheet passing areas L3, L4, even if the recording material (not correctly set in the sheet feeding cassette) is conveyed with lateral deviation, the fixing ability at both lateral ends of the small sized sheet is maintained adequately.

Further, since the width sensor is positioned at the position relatively spaced apart from the end of the small sized sheet passing area L1, even if the small sized sheet is skew-fed, the sensor does not recognize the small sized sheet as the large sized sheet.

Incidentally, regarding the evaluation of the fixing ability and the measurement of the temperature of the pressurizing roller, in a condition that the temperature is temperature-adjusted to be 200° C. and the recording material is fixed by using the small sized sheet heat generating element and an evaluation pattern is printed by a printer having a recording material conveying speed of 150 (mm/sec), the image pattern portion is frictionally slid, and densities before and after the sliding are measured to obtain reduction therebetween, thereby evaluating the fixing ability.

Next, other embodiments of the present invention will be explained.

In another embodiment, in a fixing device of zone heating type in which the heat generating element is selected in accordance with the size width of the recording material, when the small sized recording material is fixed, a plurality of heat generating elements are simultaneously heated, and the sheet size sensor is disposed outside of the portion (in the longitudinal direction) having the greater heat generating amount.

Figure 8:
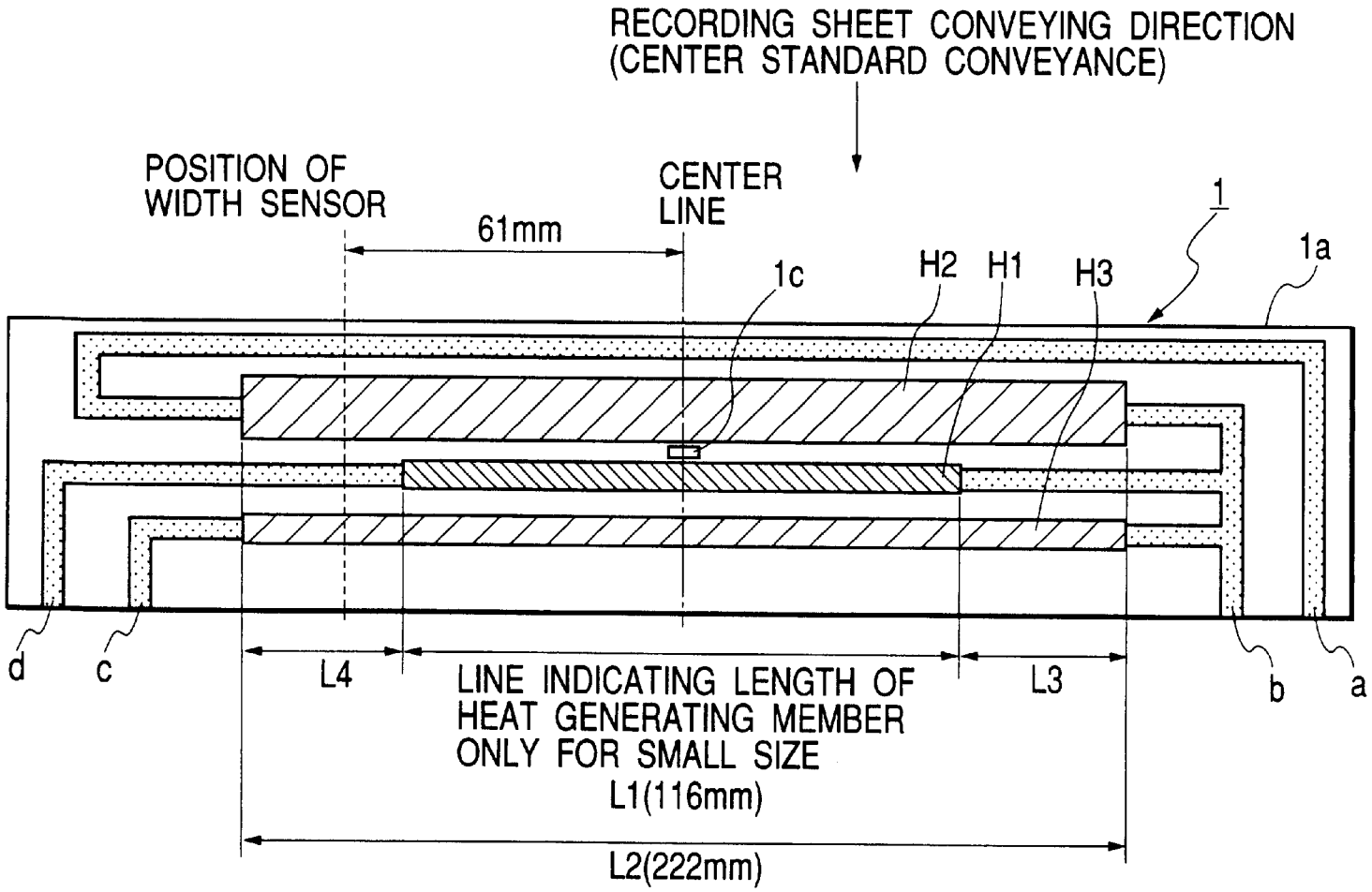
FIG. 8 is a schematic view showing heating elements and electricity supplying electrode patterns of a heating body in another example.

FIG. 8 is a view showing a pattern of the heat generating elements of the heater 1 in this embodiment. A heater 1 according to this embodiment has a small sized and large sized sheet heat generating element (second heat generating element) H2, a small sized sheet heat generating element (first heat generating element) H2, and a large sized sheet heat generating element (third heat generating element) H3.

The heat generating elements are coated by a glass layer, so that the elements are insulated from a thermistor 1*c* for effecting temperature control of the heater, and a film surface.

Further, the heat generating elements are heated on a heater substrate la by supplying electricity to electricity supplying electrodes a, b, c, d.

The heat generating element to be driven is selected by detecting the size of the recording material being passed by means of the width sensor 25 provided in the recording material conveying path, and, when the large sized sheet is passed, electricity is supplied between the electricity supplying electrode patterns a and c, thereby heating the heat generating elements H2, H3.

When the small sized recording material having a width smaller than L1 is passed, electricity is supplied between the electricity supplying electrode patterns a and b, thereby heating the heat generating elements H1, H2.

In the illustrated embodiment, in case of the small sized recording material, although the heat generating element H2 is also energized, the energization is controlled so that the heater reaches the predetermined temperature by the heat generating element H1 and the heat generating element H2. In this case, the electricity supplying amount to the heat generating element H2 in the illustrated embodiment is smaller in comparison with the case where the energization is controlled to reach the predetermined temperature only by the heat generating element H2, thereby preventing the over-heat of the non-sheet passing areas.

The other constructions of the heater and the fixing device are the same as those in the aforementioned embodiment.

Figure 9:
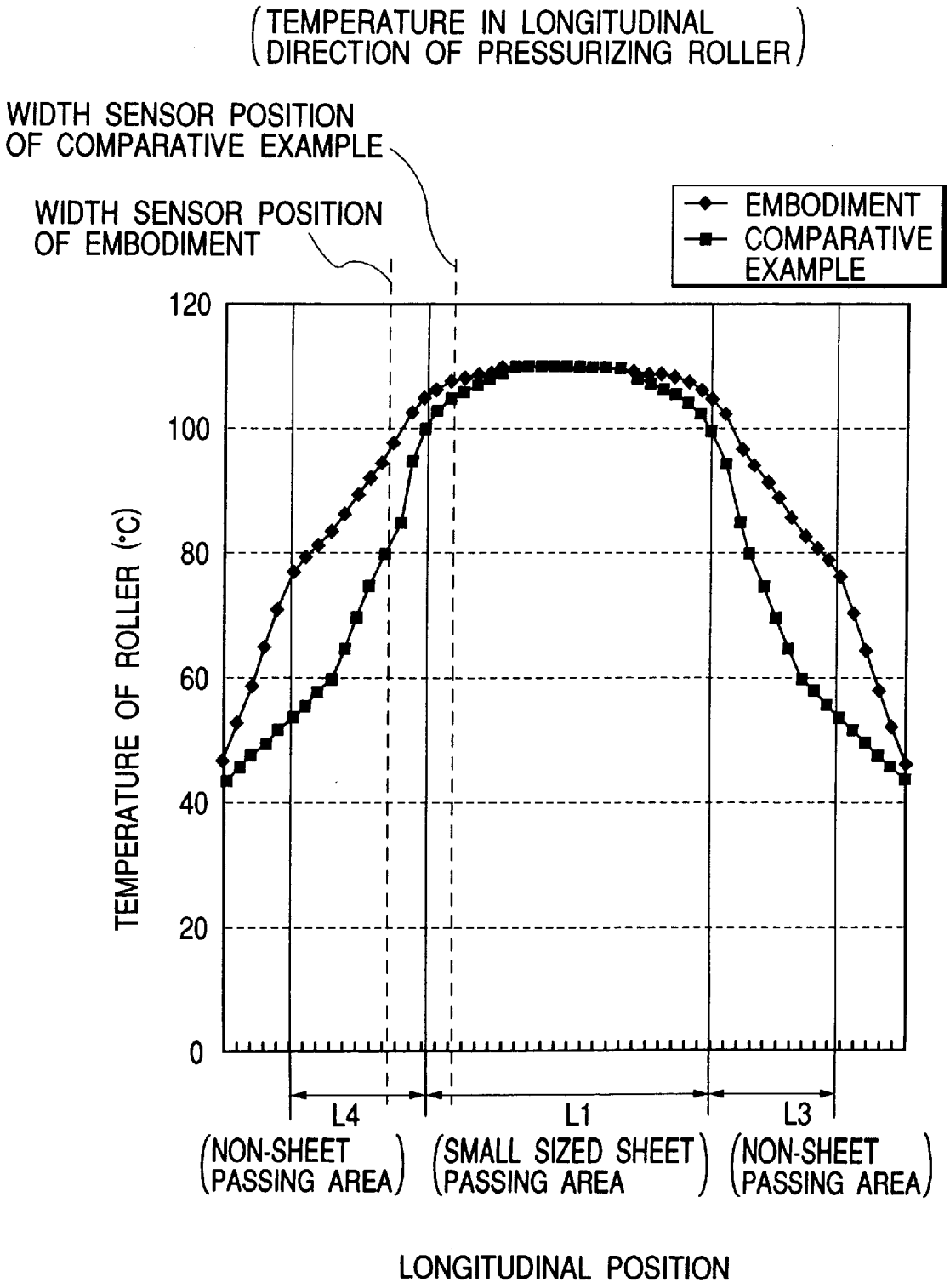
FIG. 9 is a view showing temperature distribution of a pressurizing roller in a longitudinal direction thereof.

FIG. 9 is a graph showing temperature distribution in a longitudinal direction of the pressurizing roller before the sheet enters into the fixing nip portion N when the small sized sheet is fixed by using the small sized sheet heat generating element or body, in each of the illustrated embodiment and the comparative example.

In the illustrated embodiment, when the large sized sheet is passed, the area L2 in the fixing nip portion is uniformly heated by the heat generating element H2 and H3.

When the small sized sheet is passed, at the small sized sheet passing area L1, the heat generating amount QL1 per unit longitudinal length is increased by using the heat generating elements H1, H2, and the heat generating amounts QL3, QL4 of the small sized sheet non-passing areas L3, L4 are made $QL3=QL4=\frac{1}{2}\cdot QL1$.

The width sensor is disposed outside of the small size sheet passing area L1 which is a portion having greater heat generating amount when the small sized sheet heat generating elements H1, H2 are heated. Namely, the width sensor is provided outside of the heat generating element H1 and inside of the heat generating element H2 with respect to the longitudinal direction of the heater.

Similar to the aforementioned embodiment, the width sensor is disposed at a position spaced apart from the centerline of the heater by 61 mm, and the heat generating element to be heated is selected on the basis of the detection result (i.e., whether greater than or smaller than the predetermined width) of the width sensor, and the heat generating elements H1, H2 or energization of the heat generating elements H2, H3 are controlled so that the detection temperature of the thermistor 1*c* becomes the predetermined temperature.

Similar to the aforementioned embodiment, also in the small sized sheet non-passing areas L3, L4, since the pressurizing roller is moderately warmed by the large sized and small sized sheet heat generating element H2, even if the small sized sheet is skew-fed or the small sized incorrectly set in the sheet feeding cassette is supplied, the good fixing ability can be achieved even at the end of the small sized sheet heat generating element. Further, since the width sensor is arranged at the position relatively spaced apart from the end of the heat generating element H1, even if the small sized recording material is skew-fed, the sensor does not recognize the recording sheet as a large sized sheet.

Incidentally, the apparatus and method used for the evaluation of the fixing ability and measurement of the temperature of the pressurizing roller are the same as those in the aforementioned embodiment.

According to the illustrated embodiment, similar to the aforementioned embodiment, even if the small sized sheet is skew-fed to be deviated laterally, the good fixing ability at the lateral end of the small sized sheet can be maintained. Further, since the small sized recording material is not erroneously recognized as the large sized recording material and thus the non-sheet passing portions are not overheated, the damage of the pressurizing roller and the film can be suppressed, thereby extending the service life of the apparatus.

Incidentally, the heater substrate 1*a* may be formed from other material such as alumina ($A1_2O_3$) or silicon carbide (SiC), as well as aluminum nitride (AlN).

Further, a surface heating type heater in which heat generating element are formed on a surface of a heater substrate opposed to a fixing nip portion may be used.

Further, the temperature detecting element is not limited to the thermistor.

In addition, a heater and a fixing device having one side sheet passing reference can be used.

In the present invention, as a fixing device, a device in which a recording material bearing an image is heated to improve the surface feature such as luster or a device for effecting preliminary fixing may be used, as well as the fixing device in which the non-fixed image is thermally fixed to the recording material temporarily.

While the present invention was described with reference to specific embodiments, the present invention is not limited to such embodiments, but various alteration can be made within the scope of the invention.

What is claimed is:

1. An image heating apparatus comprising:

a heater, an image on a moving recording material being heated by a heat from said heater, said heater including an elongated substrate extending in a direction perpendicular to a shifting direction of the recording material, and a first heat generating body and a second heat generating body for generating heat by energization and provided on said substrate along a longitudinal direction thereof, said first and second heat generating bodies being disposed side by side in a direction perpendicular to the longitudinal direction of said substrate, and said first heat generating body having a first heat generating portion, and a second heat generating portion provided at a longitudinal end of said first heat generating portion and having a heat generating amount per unit length smaller than that of said first heat generating portion; and a detecting member for detecting a width of the recording material, wherein when the width of the recording material is detected to be smaller than a predetermined width by said detecting member, said first heat generating body is energized, and, when the width of the recording material is detected to be greater than the predetermined width, said second heat generating body is energized, and said detecting member is provided at a position corresponding to said second heat generating portion in the longitudinal direction of said substrate.

2. An image heating apparatus according to claim 1, wherein a width of said first heat generating portion is smaller than a width of said second heat generating portion with respect to a direction perpendicular to the longitudinal direction of said substrate.

3. An image heating apparatus according to claim 1, wherein said second heat generating portions are provided on both longitudinal ends of said first heat generating portion.

4. An image heating apparatus according to claim 1, further comprising a film having one surface slidingly contacted with said heater and the other surface contacted with the recording material, wherein the image on the recording material is heated by heat from said heater via said film.

5. An image heating apparatus comprising:

a heater, an image on a moving recording material being heated by a heat from said heater, said heater including an elongated substrate extending in a direction perpendicular to a shifting direction of the recording material, and a first heat generating body and second heat generating body for generating heat by energization and provided on said substrate along a longitudinal direction thereof, said first and second heat generating bodies being disposed side by side in a direction perpendicular to the longitudinal direction of said substrate, and a length of said first heat generating body being smaller than a length of said second heat generating body with respect to the longitudinal direction of said substrate; and a detecting member for detecting a width of the recording material, wherein when the width of the recording material is detected to be smaller than a predetermined width by said detecting member, said first and second heat generating bodies are energized, and, when the width of the recording material is detected to be greater than the predetermined width, said second heat generating body is energized, and said detecting member is provided at a position outside of said first heat generating body and inside of said second heat generating body in the longitudinal direction of said substrate.

6. An image heating apparatus according to claim 5, further comprising temperature detecting means for detecting a temperature of said heater, wherein energization of said first and second heat generating bodies is controlled so that a detected temperature from said temperature detecting means becomes a predetermined temperature.

7. An image heating apparatus according to claim 5, wherein said heater includes a third heat generating body provided along the longitudinal direction of said substrate and adapted to generate heat by energization, and when the width of the recording material is detected to be greater than the predetermined width by said detecting member, said second and third heat generating bodies are energized.

8. An image heating apparatus according to claim 5, further comprising a film having one surface slidingly contacted with said heater and the other surface contacted with the recording material, wherein the image on the recording material is heated by heat from said heater via said film.

* * * * *

UNITED STATES PATENT AND TRADEMARK OFFICE

CERTIFICATE OF CORRECTION

PATENT NO. : 6,185,383 B1
DATED : February 6, 2001
INVENTOR(S) : Kenji Kanari et al.

It is certified that error appears in the above-identified patent and that said Letters Patent is hereby corrected as shown below:

Title page,
Item [57], ABSTRACT,
Line 3, "a" (1st occurrence) should be deleted.

Column 1,
Lines 24 and 38, "born" should read -- borne --.

Column 2,
Line 36, "shows" should read -- show --.

Column 3,
Line 53, "used" should read -- used --.

Column 4,
Line 41, "small as less" should read -- as small --.

Column 5,
Line 12, "a" (2nd occurrence) should be deleted.

Column 6,
Line 57, "are" should read -- is --.

Column 7,
Line 7, "synchronous" should read -- synchronism --.

Column 9,
Line 2, "is risen" should read -- rises --.
Line 5, "born" should read -- borne --.

UNITED STATES PATENT AND TRADEMARK OFFICE

CERTIFICATE OF CORRECTION

PATENT NO. : 6,185,383 B1
DATED : February 6, 2001
INVENTOR(S) : Kenji Kanari et al.

It is certified that error appears in the above-identified patent and that said Letters Patent is hereby corrected as shown below:

Column 13,
Line 17, "element" should read -- elements --.
Line 36, "a" should be deleted.

Signed and Sealed this

Fifteenth Day of January, 2002

*Attest:*

*Attesting Officer*

JAMES E. ROGAN
*Director of the United States Patent and Trademark Office*